US006176773B1

(12) United States Patent
Mikami et al.

(10) Patent No.: US 6,176,773 B1
(45) Date of Patent: Jan. 23, 2001

(54) COIN DISPENSER

(75) Inventors: Mitsugu Mikami, Kawagoe; Kenji Nakajima, Iruma-gun; Takahiro Hayashi, Kitamoto, all of (JP)

(73) Assignee: Kabushiki Kaisha Nippon Conlux, Tokyo (JP)

( * ) Notice: Under 35 U.S.C. 154(b), the term of this patent shall be extended for 0 days.

(21) Appl. No.: 09/355,417

(22) PCT Filed: Nov. 25, 1998

(86) PCT No.: PCT/JP98/05313

§ 371 Date: Jul. 27, 1999

§ 102(e) Date: Jul. 27, 1999

(87) PCT Pub. No.: WO99/28868

PCT Pub. Date: Oct. 6, 1999

(30) Foreign Application Priority Data

Nov. 28, 1997 (JP) ..... 9-328249

(51) Int. Cl.[7] ..... G07D 1/00

(52) U.S. Cl. ..... 453/21; 453/24

(58) Field of Search ..... 453/20, 21, 22, 453/23, 24, 25, 26

(56) References Cited

FOREIGN PATENT DOCUMENTS

| | | | |
|---|---|---|---|
| 5805892 | 1/1983 | (JP) | G07D/1/00 |
| 0267466 | 5/1990 | (JP) | F02P/15/00 |
| 0267475 | 5/1990 | (JP) | F04B/39/00 |
| 2130059 | 10/1990 | (JP) | H04M/1/19 |
| 0523279 | 3/1993 | (JP) | A47L/15/42 |
| 0711466 | 5/1995 | (JP) | G07F/3/04 |

*Primary Examiner*—F. J. Bartuska
(74) *Attorney, Agent, or Firm*—Hogan & Hartson, LLP

(57) ABSTRACT

Coin dispenser, wherein a change slide (31) for controlling the dispensation and non-dispensation of coins is turned when the coins are dispensed, and then stored in a change slide storage hole (4*f*) formed inside a payout link (4), whereby depthwise length of the coin dispenser is reduced to the smallest possible level.

3 Claims, 21 Drawing Sheets

COIN DISPENSER

TECHNICAL FIELD

This invention concerns a coin processing apparatus, used in automatic vending machines, money changing machines and service equipment, etc., and more particularly concerns improvements in a coin dispenser that constitutes part of such a coin processing apparatus and that pays out coins that have been sorted and held by denomination according to the amount of change being returned.

BACKGROUND ART

Conventional automatic vending machines, money changing machines and service equipment, etc., have been equipped with coin processing apparatus that, in addition to determining the genuineness of inserted coins, sorts and holds those inserted coins deemed genuine by denomination, and also pays out the sorted and held coins according to the amount of change being returned.

The coin processing apparatus, in general terms, comprises the following three main constituting elements.

The first main constituting element comprises coin sorting means that determines the genuineness of inserted coins and sorts, by denomination, the genuine coins.

The second main constituting element comprises a coin holding apparatus comprising a plurality of coin tubes that respectively hold coins by denomination, which coins have been sorted by denomination by the coin sorting means.

The third main constituting element comprises a coin dispenser that selects coins from inside the coin tubes constituting the coin holding apparatus, according to the amount of change being returned, and pays those selected coins out.

Of these, the conventional coin dispenser 1 has the structure depicted in the schematic perspective view of major components given in FIG. 18.

The coin dispenser 1 comprises payout cam drive means (not shown in the drawings) comprising drive motor gears that transmit the driving force of the drive motor; a payout link 4 that comprises a pair of payout cams 2 and 3 that are turned one revolution in one direction (clockwise) every payout operation by the driving force transmitted via the payout cam drive means and channels 4*a* and 4*b* engaged with pins 2*a* and 3*a* projecting from the lower surfaces of the payout cams 2 and 3, and that moves reciprocally in the directions of arrow A from the initial position in the drawing when the payout cams 2 and 3 turn one revolution in the direction of the arrows (clockwise); and a payout slider 5 that engages the payout link 4 through the pair of pins 4*c* and 4*d* and moves reciprocally in the directions of the arrow A in linkage with the reciprocal motion of the payout link 4. The payout drive means (not shown), as described above, payout cams 2 and 3 and payout link 4 constitute payout slider drive means 6.

In the payout slider 5 are formed four holes 7, 8, 9 and 10 for holding, respectively, a single coin of the coins held at the bottoms of the coin tubes (not shown) that constitute the coin holding apparatus described above. On the bottom sides of the holes 7, 8, 9 and 10 are provided a bottom plate 11 that covers the bottom surface of the payout slider 5 and that ordinarily does not move, in the initial position depicted in FIG. 18, so as to prevent coins held in the holes 7, 8, 9 and 10 from falling down. The bottom plate 11 configures the bottom surface of the plurality of coin tubes (not shown) that constitute the coin holding apparatus.

Inside the payout link 4, change slides 12, 13, 14 and 15 for controlling the paying out and non- paying out of the coins held one at a time inside the corresponding holes 7, 8, 9, 10, are inserted such that they can go in and out freely. The ends of the change slides front at the bottoms of the corresponding holes 7, 8, 9 and 10 in the payout slider 5.

The change slides 12, 13, 14 and 15 are provided with stopper means (not shown) for stopping their movement from the initial position depicted in FIG. 18 toward the payout link 4 side. Thus, the structure is such as to allow the movement of the change slides 12, 13, 14 and 15 toward change solenoids 16, 17, 18 and 19 following the sliding movement of the payout link 4 in the directions of the arrow A, while checking the movement from the initial positions depicted in FIG. 18 toward the payout link 4.

Furthermore, the change slides 12, 13, 14 and 15 described above are installed such that the tip 12*a* of the change slide 12 fronts inside the hole 7, the tip 13*a* of the change slide 13 fronts inside the hole 8, the tip 14*a* of the change slide 14 fronts inside the hole 9 and the tip 15*a* of the change slide 15 fronts inside the hole 10.

The back ends 12*b*, 13*b*, 14*b* and 15*b* of the change slides 12, 13, 14 and 15, respectively, in their initial positions, are engaged by change levers 16*a*, 17*a*, 18*a* and 19*a* configured by the plungers of the change solenoids 16, 17, 18 and 19, respectively, that are installed independently for the change slides 12, 13, 14 and 15. The movement of these change slides, that is to say, movement toward the change solenoids 16, 17, 18 and 19, is ordinarily checked.

According to the coin dispenser 1 described in the foregoing, when a signal is input from a controller (not shown) to pay out one coin (not shown) held in the hole 9, for example, in response to that payout signal, the payout cams 2 and 3 are turned through one revolution in the direction of the arrows by the payout cam drive means (not shown), causing the payout slider 5 to move reciprocally in the directions of the arrow A, which would cause the coins held in the holes 7, 8, 9 and 10 in the payout slider 5 to drop one at a time down below the holes 7, 8, 9 and 10. However, as depicted in FIG. 19, based on the signal to pay out one coin held in the hole 9, only the change lever 18*a* of the change solenoid 18 that checks the movement of the back end 14*b* of the change slide 14 is activated, moving upward as indicated by the arrow B, thus releasing the engagement between the change lever 18*a* and the change slide back end 14*b*.

Thereupon, as depicted in FIG. 20 (from which the payout cams 2 and 3 have been omitted), only the change slide 14 slides backward, following the movement of the payout link 4 in the directions of the arrow A, whereby the opening in the bottom of the hole 9 is maintained so that the coin held in the hole 9 drops down and is paid out.

As depicted in FIG. 20, since the back ends 12*b*, 13*b* and 15*b* of the other change slides 12, 13 and 15 have their movement checked by the change levers 16*a*, 17*a* and 19*a*, respectively, depending on the amount of movement of the payout link 4, the change slide tips 12*a*, 13*a* and 15*a* advance at the bottoms of the holes 7, 8 and 10 corresponding thereto. Therefore, the bottoms of those holes 7, 8 and 10 are not released, and, accordingly, the coins held in those holes 7, 8 and 10 do not fall down below the bottoms of the holes 7, 8 and 10 despite the reciprocal movement in the directions of the arrow A of the payout slider 5, and are thus not paid out.

In other words, the coin dispenser described in the foregoing is configured so that, if change levers 16*a*, 17*a*, 18*a* and 19*a* corresponding to coins to be paid out are activated (moved upward), thus releasing the checks on the movements of the change slides 12, 13, 14 and 15 corresponding to the coins to be paid out, those coins can be paid out. When paying out a plurality of coins of the same denomination, the change lever of the change solenoid correspond to that coin to be paid out is activated (moved upward), thereby releasing the check on the movement of that change slide, and thereafter it is only necessary to move the payout slider 5 reciprocally a number of times coinciding with the number of coins to be paid out. Also, when paying out a plurality of types of coins simultaneously, the change levers of a plurality of change solenoids corresponding to that plurality of types of coin are activated (moved up) simultaneously, thereby releasing the checks on the movements of the change slides corresponding to that plurality of types of coin to be paid out, so that plurality of types of coin can be paid out simultaneously.

When, on the other hand, the coin dispenser 1 described in the foregoing is to be employed in various countries of the world where different types and diameters of coins are used, it is desirable to provide as many functions as possible in the coin dispenser 1 so that it can pay out many types of coins.

Thus, we can conceive of a construction where, a function for paying out another different type of coin having a large diameter is added to the conventional coin dispenser 1.

FIG. 21 is a schematic perspective view of the major components of a coin dispenser 20, which was proposed earlier by the applicant, wherein the basic structure of the conventional coin dispenser 1 depicted in FIG. 18 is adopted, but wherein a feature is added for paying out another different coin having a large diameter, so that it is provided with features for paying out a total of five types of coin. The same reference symbols as used in FIG. 18 are used to indicate identical components.

With the coin dispenser 20, the payout link 4, payout slider 5 and bottom plate 11, respectively, are elongated toward the left (in the drawing) to accommodate the placement of a change slide 21 having the same structure as the change slides 12, 13, 14 and 15 as described above. A hole 22 is also formed in the elongated payout slider 5 to hold another coin of a large diameter.

A change solenoid 23 is provided at the back end 21*b* of the change slide 21, similar to the change solenoids 16, 17, 18 and 19 noted earlier, and a change lever 23*a* configured by the plunger thereof is engaged with the back end 21*b* of the change slide 21.

According to such a coin dispenser 20, when a signal is input from a controller (not shown) to pay out one large-diameter coin held in the hole 22, based on that payout signal, the payout cams 2 and 3 are turned through one revolution, in the direction of the arrows, by the payout drive means (notshown), causing the payout slider 5 to move reciprocally in the directions of the arrow A, so that the coins held in the holes 7, 8, 9, 10 and 22 of the payout slider 5 are dropped one at a time down through the holes 7, 8, 9, 10 and 22. When this is being done, however, as depicted in FIG. 22, based on a signal to pay out one coin held in the hole 22, only the change lever 23*a* of the change solenoid 23 that checks the movement of the back end 21*b* of the change slide 21 is activated so that it moves upward as indicated by the arrow B, thus releasing the engagement with the change slide back end 21*b*.

Thereupon, as depicted in FIG. 23 from which the payout cams 2 and 3 have been omitted, only the change slide 21 slides backward following the movement of the payout link 4 in the directions of the arrow A (in FIG. 22), whereby the opening at the bottom of the hole 22 is maintained, so that the coin held in the hole 22 is dropped down from the hole 22 and is paid out.

Accordingly, it is possible to pay out five or more types of coins using the same basic payout structure as in the conventional coin dispenser 1 described earlier.

However, a coin processing apparatus wherein the coin dispenser 1 or 20 described above is loaded, is usually to be loaded in an extremely limited and narrow space inside automatic vending machines or equipment. Therefore, the overall size of the coin processing apparatus is strictly controlled.

In particular, the dimension L in the depth direction from the front to the back in the coin dispenser 1, inclusive of the distance of reciprocal movement of the change slide 14 when paying out coins, is strictly specified.

However, with the need to pay out as many types of coins as possible, according to the coin dispenser 20 wherein the conventional structure depicted in FIG. 18 is adopted but wherein also a feature is added for paying out another coin of large diameter as depicted in FIG. 21, for example, in order to pay out that coin of large diameter, the dimension L' in the depth direction from the front to the back in the coin dispenser 20, inclusive of the distance of reciprocal movement of the change slide 21, becomes extremely large (L'>L). Thus there is a danger of being unable to install a coin processing apparatus wherein is loaded such a coin dispenser 20, within the limited space available inside an automatic vending machine, etc.

In view of the situation described in the foregoing, an object of the present invention is to provide a coin dispenser wherewith even more types of coins can be paid out without increasing the dimension in the depth direction.

DISCLOSURE OF THE INVENTION

In order to resolve the problem described above, the coin dispenser of the present invention comprises change slide accommodating means for accommodating the change slide inside the payout link along longitudinal direction thereof; and change slide turning means for turning the change slide in conjunction with movement of the payout link when paying out coins, wherein when paying out the coins, the change slide is turned by the change slide turning means so as to be accommodated inside the change slide accommodating means.

BEST MODE FOR CARRYING OUT THE INVENTION

Embodiments of a coin dispenser according to the present invention are now described in detail.

Figure 1:
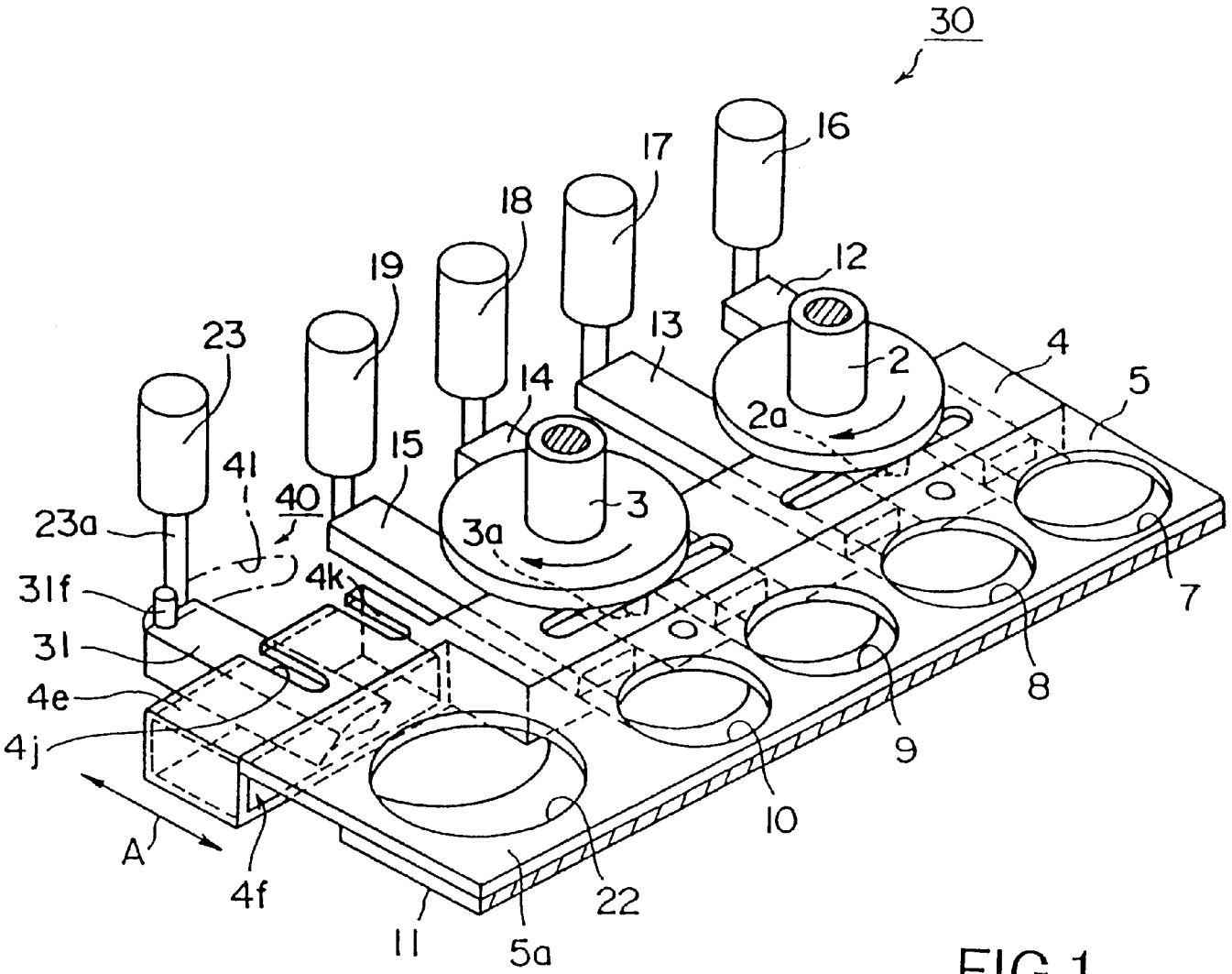
FIG. 1 is a schematic perspective view of a coin dispenser according to one embodiment of the present invention.
Figure 18:
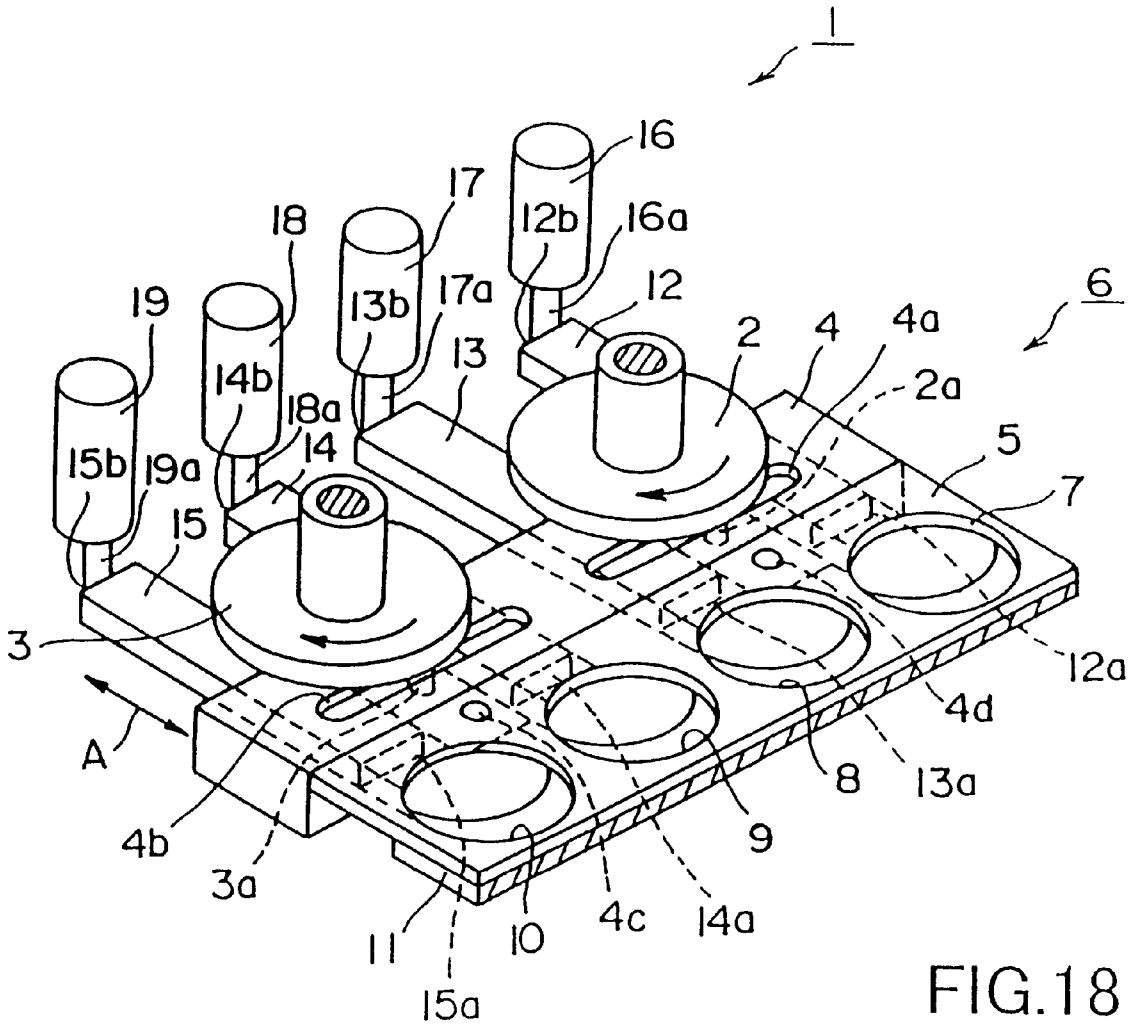
FIG. 18 PRIOR ART
FIG. 18 is a schematic perspective view of a conventional coin dispenser.
Figure 19:
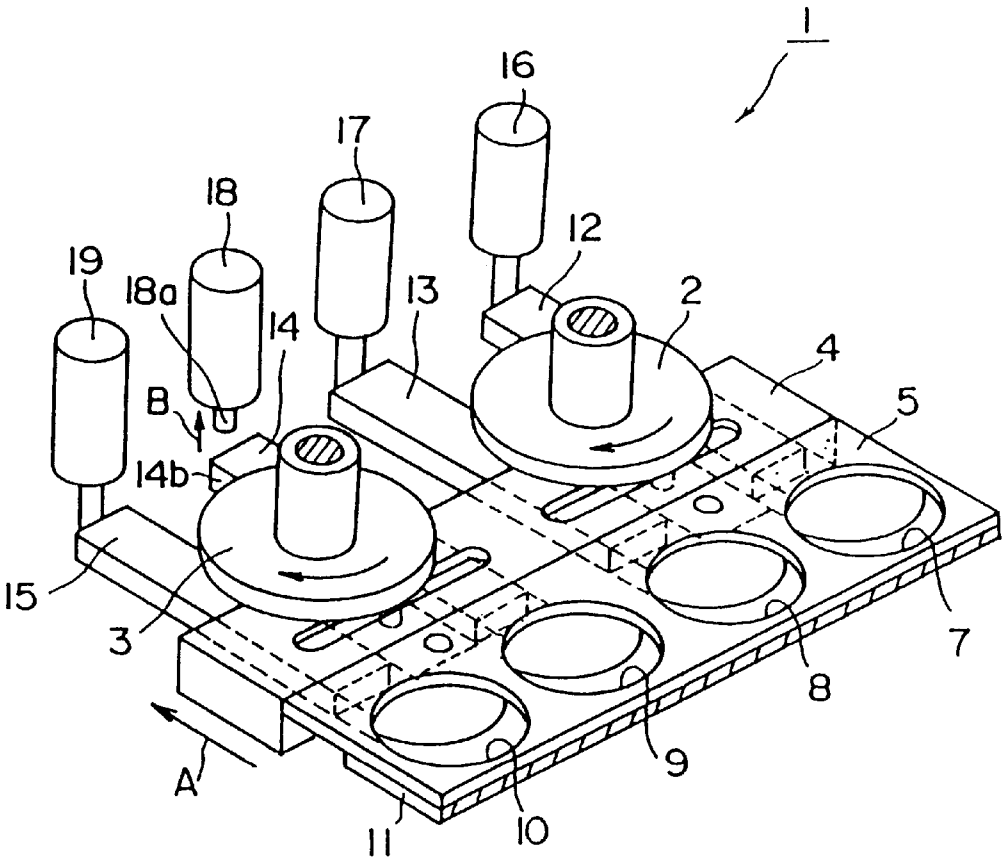
FIG.19 PRIOR ART
FIG. 19 is a schematic perspective view indicating the action of a conventional coin dispenser.
Figure 20:
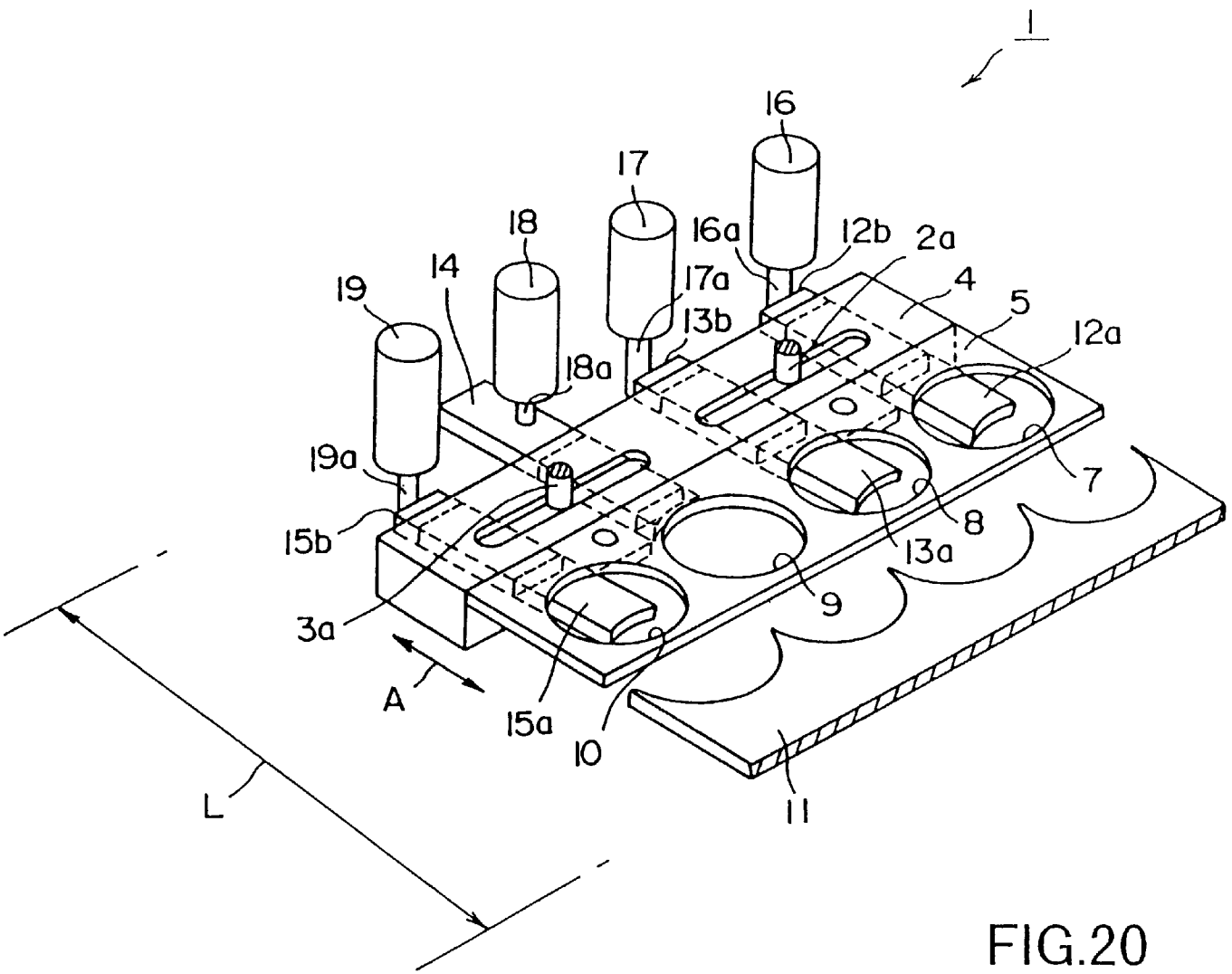
FIG.20 PRIOR ART
FIG. 20 is a schematic perspective view indicating the action of a conventional coin dispenser.
Figure 21:
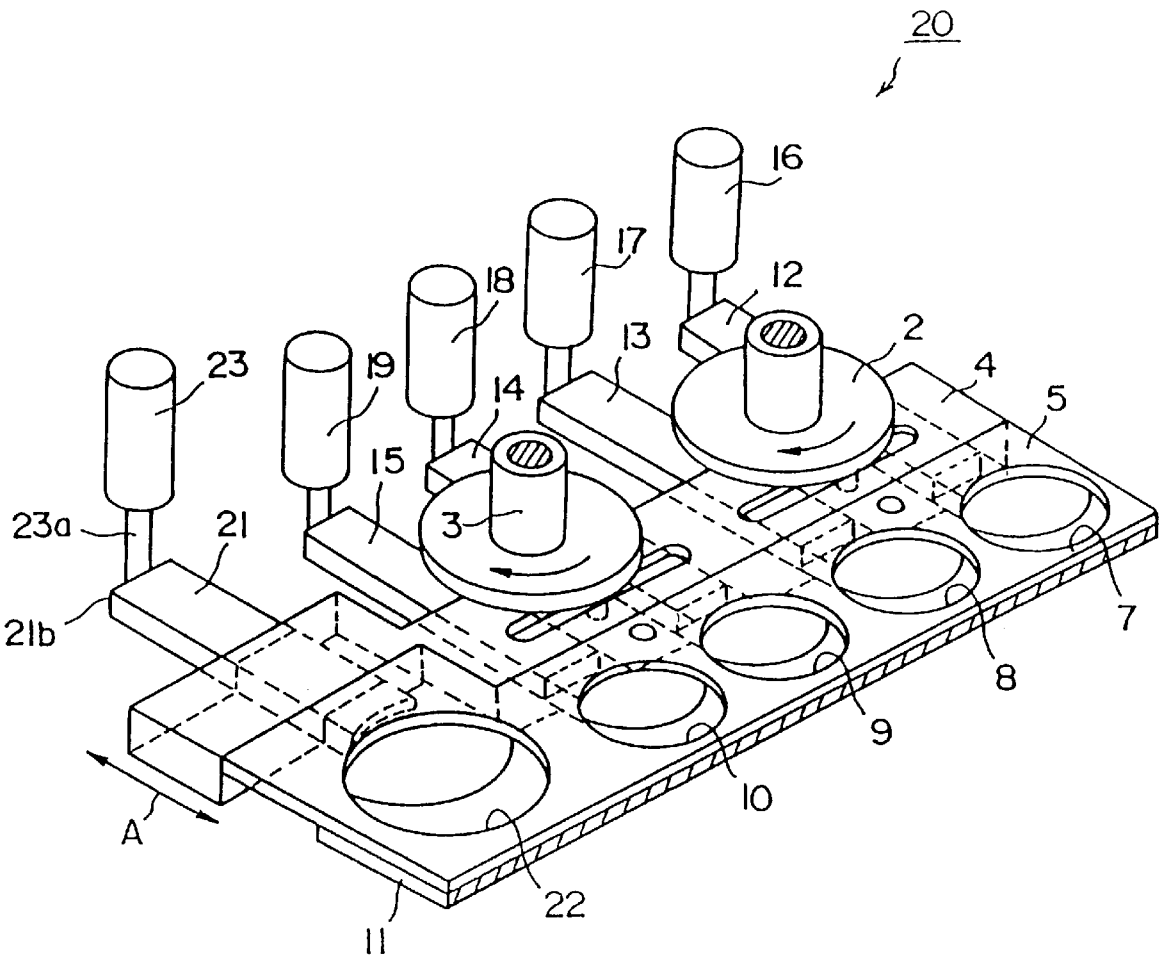
FIG.21 PRIOR ART
FIG. 21 is a schematic perspective view of a conventional coin dispenser.
Figure 22:
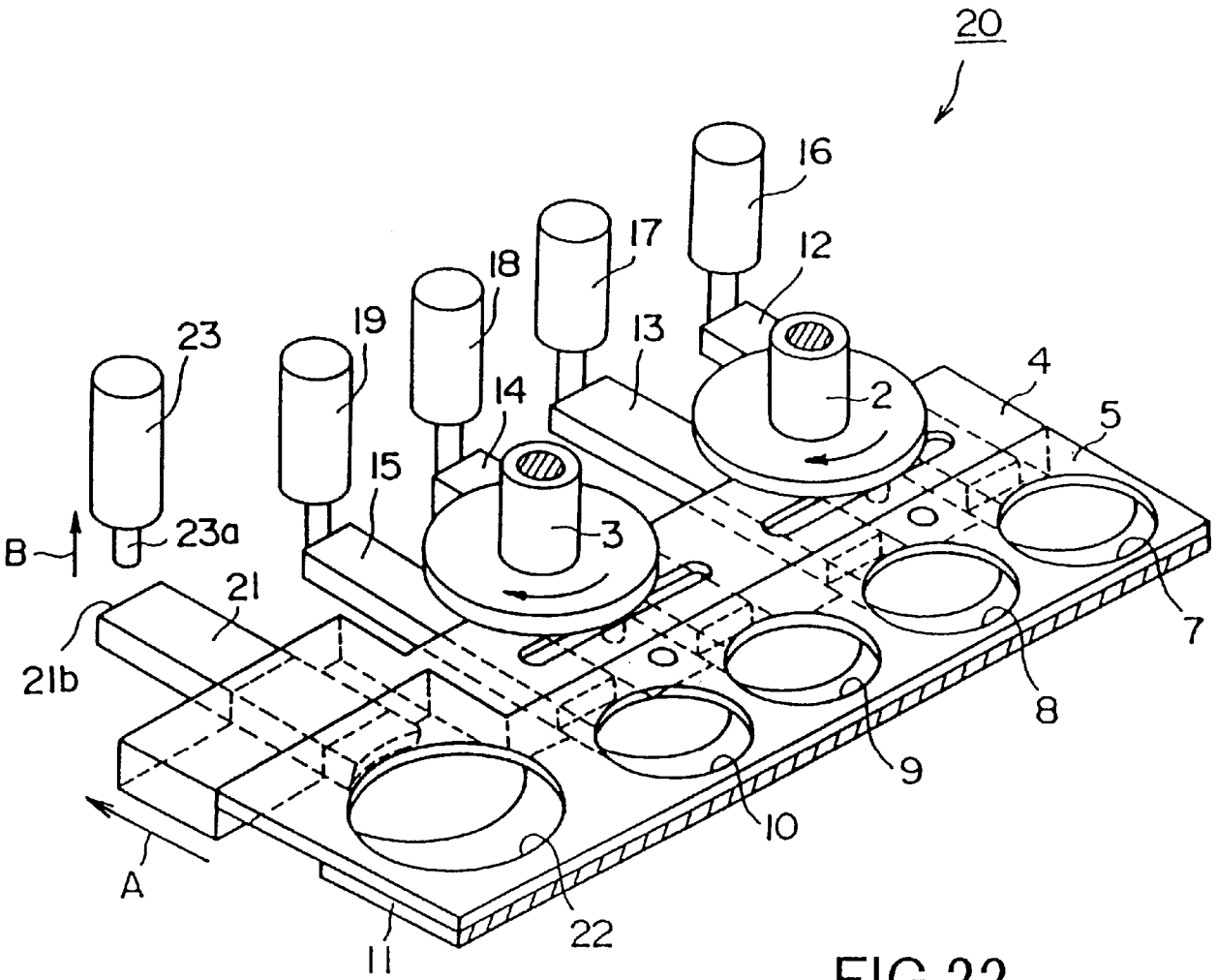
FIG.22 PRIOR ART
FIG. 22 is a schematic perspective view indicating the action of a conventional coin dispenser.
Figure 23:
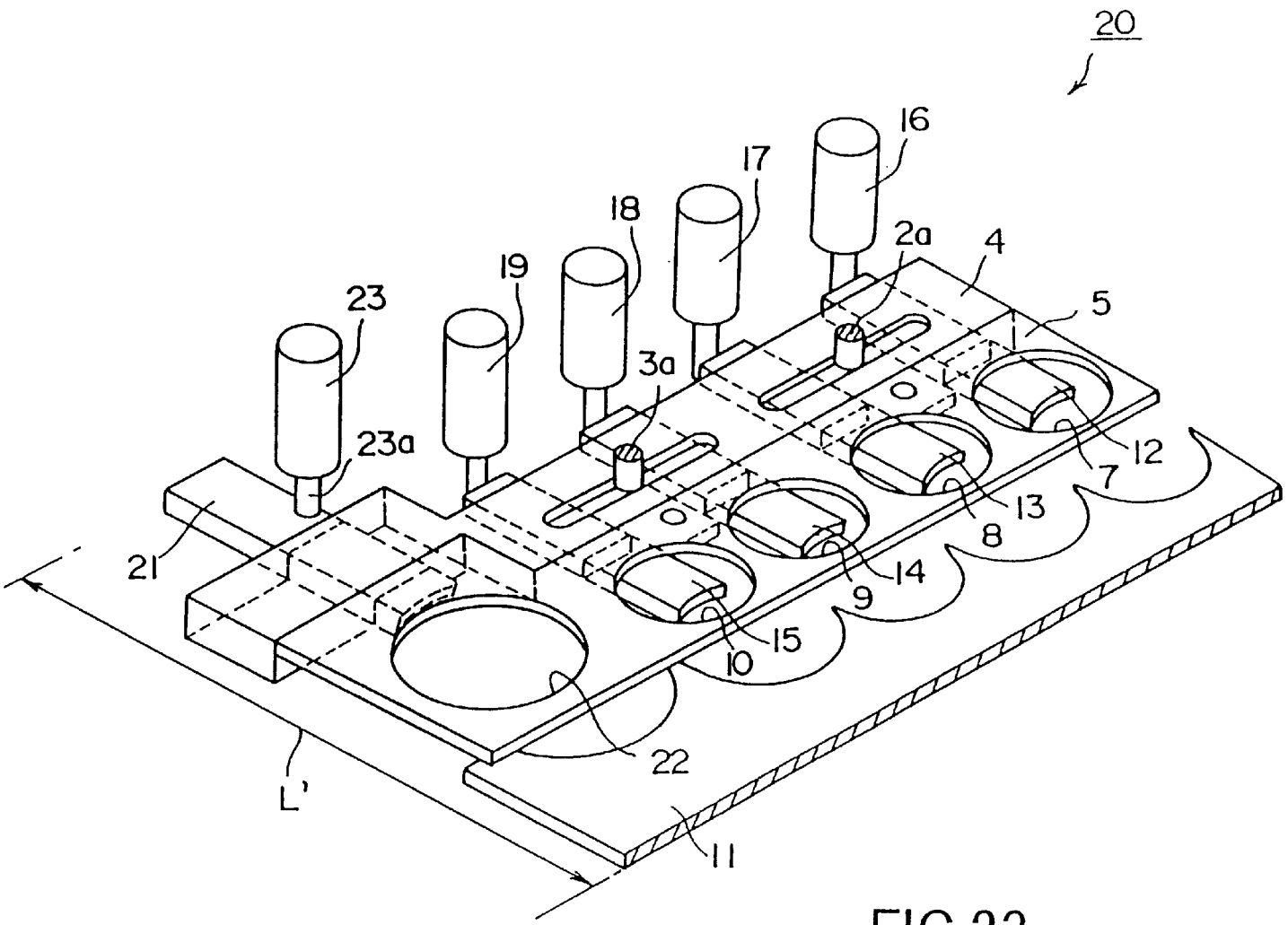
FIG.23 PRIOR ART
FIG. 23 is a schematic perspective view indicating the action of a conventional coin dispenser.

FIG. 1 is a schematic perspective view of a coin dispenser 30 of one embodiment of the present invention. The same reference symbols as used in FIGS. 18 and 21 are used to indicate identical components.

In the coin dispenser 30 also, the payout link 4, payout slider 5 and bottom plate 11, respectively, are elongated on the left side (in the drawing) to facilitate the paying out of a different type of coin of large diameter, and a hole 22 is formed in the elongated portion 5*a* of the payout slider 5 to hold one large-diameter coin.

The elongated part 4*e* of the payout link 4 is formed with a change slide storage hole 4*f* for accommodating the change slide 31 associated with the hole 22 along the longitudinal direction thereof The change slide storage hole 4*f* configures change slide accommodating means for accommodating the change slide 31 inside the payout link 4 along the longitudinal direction thereof.

Meanwhile, in a top cover (described below) that covers the upper surfaces of the change slide 31, change slide storage hole 4*f* and payout link 4, change slide turning means (described below) is formed that turn the change slide 31 in conjunction with the movement of the payout link 4 when paying out coins, respectively.

According to the coin dispenser 30, when a signal is input from a controller (not shown) to pay out one large-diameter coin (not shown) held in the hole 22, based on that payout signal, the payout cams 2 and 3 are turned through one revolution in the direction of the arrows by the payout drive means (not shown), the payout slider 5 is made to move reciprocally in the directions of the arrow A via the payout link 4, whereby the coins held in the holes 7, 8, 9, 10 and 22 in the payout slider 5 are dropped down one at a time from the holes 7, 8, 9, 10 and 22, and paid out.

Figure 2:
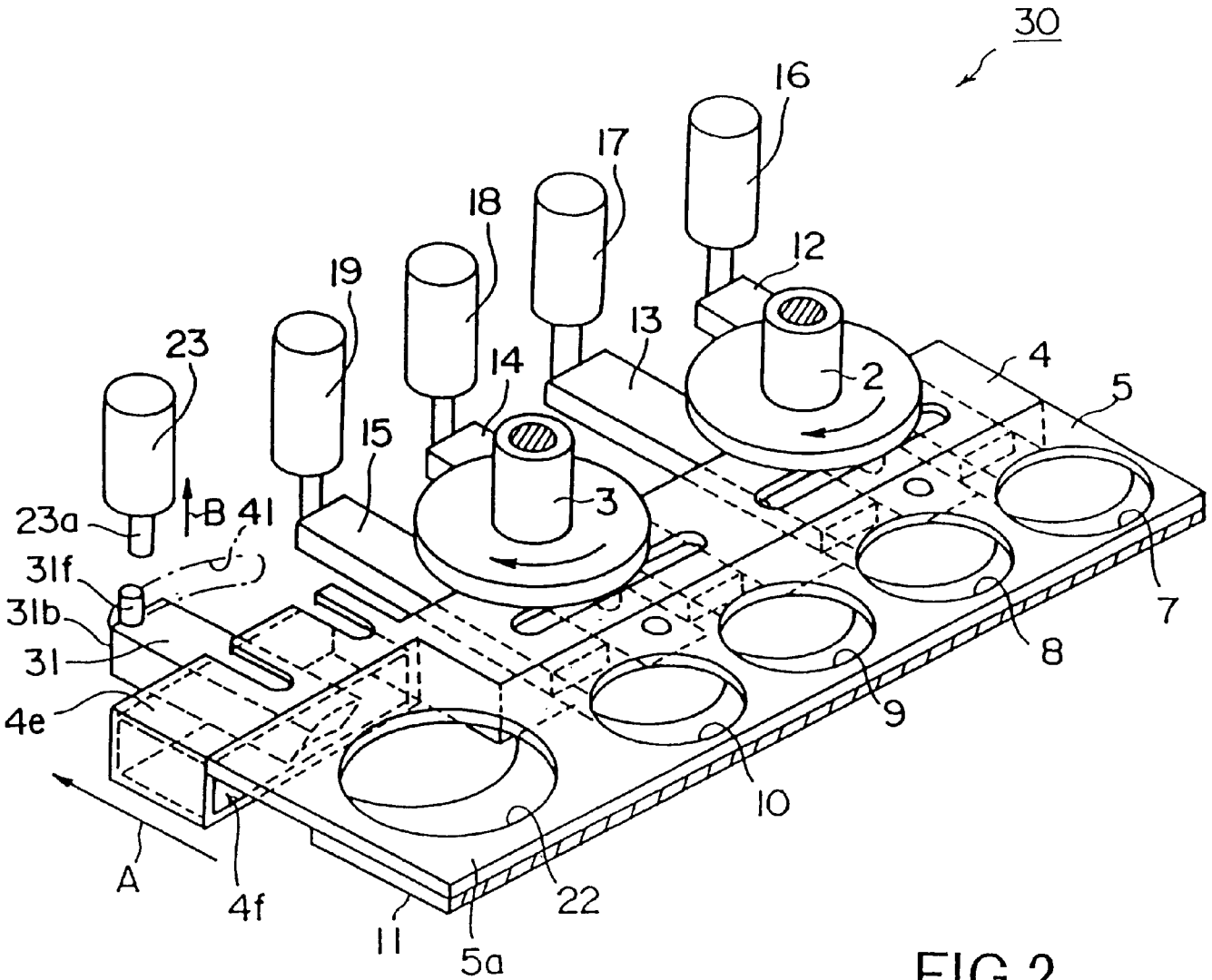
FIG. 2 is a schematic perspective view showing the action of a coin dispenser according to one embodiment of the present invention.

When this is being done, based on a signal to pay out one coin held in the hole 22, as depicted in FIG. 2, only the change lever 23*a* of the change solenoid 23 that checks the movement of the back end 31*b* of the change slide 31 is activated so that it moves upward as indicated by the arrow B, thus releasing the engagement with the change slide back end 31*b*.

Figure 3:
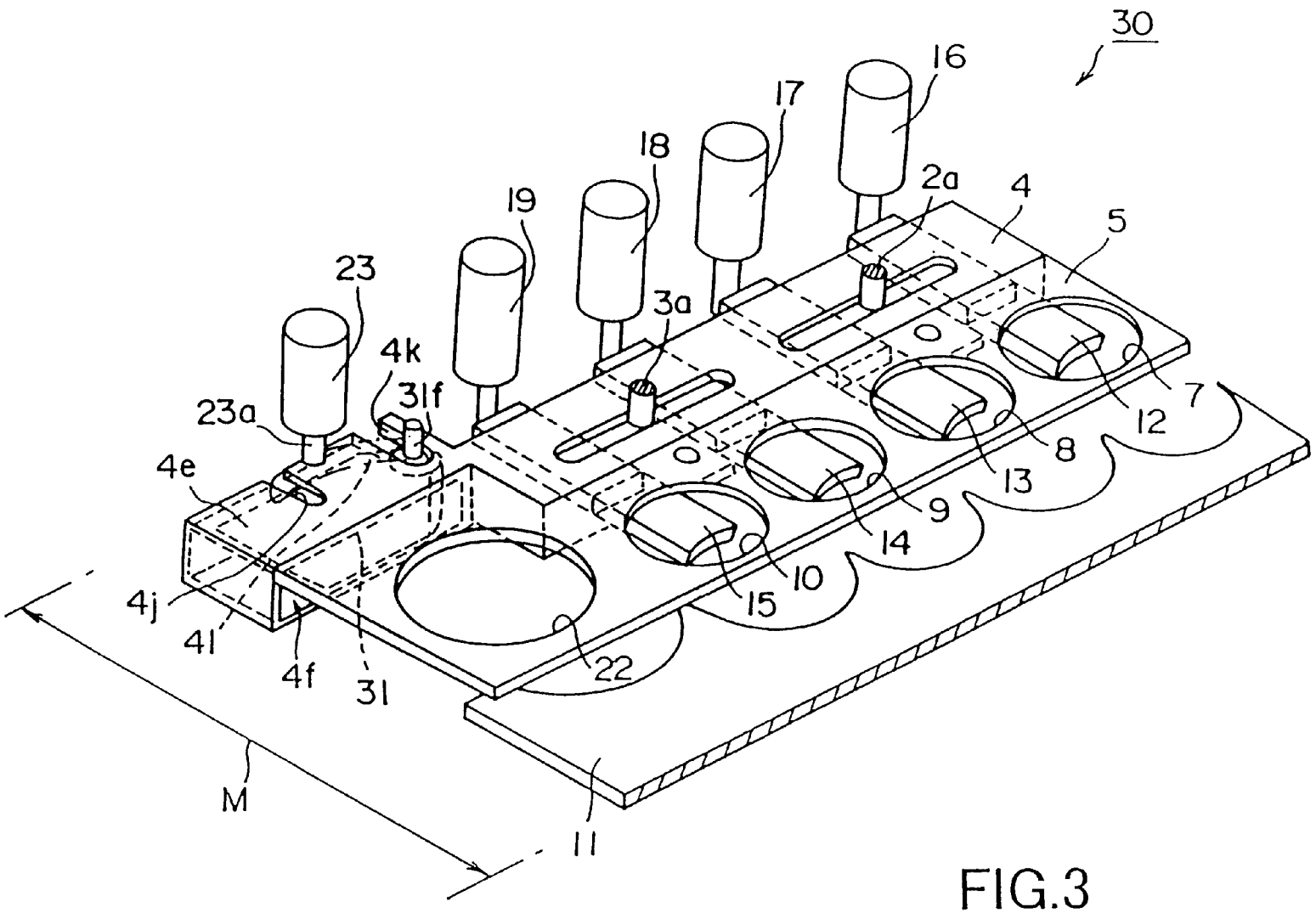
FIG. 3 is a schematic perspective view showing the action of a coin dispenser according to one embodiment of the present invention.

When this is done, as depicted in FIG. 3 from which the payout cams 2 and 3 have been omitted, only the change slide 31 turns in one direction about a turning shaft (described below) following the movement of the payout link 4, by which means the change slide 31 is accommodated inside the change slide storage hole 4*f* of the payout link 4 along longitudinal direction thereof.

Thus the release of the bottom of the hole 22 is maintained so that the coin held in the hole 22 drops down from the hole 22 and is paid out.

Figure 4:
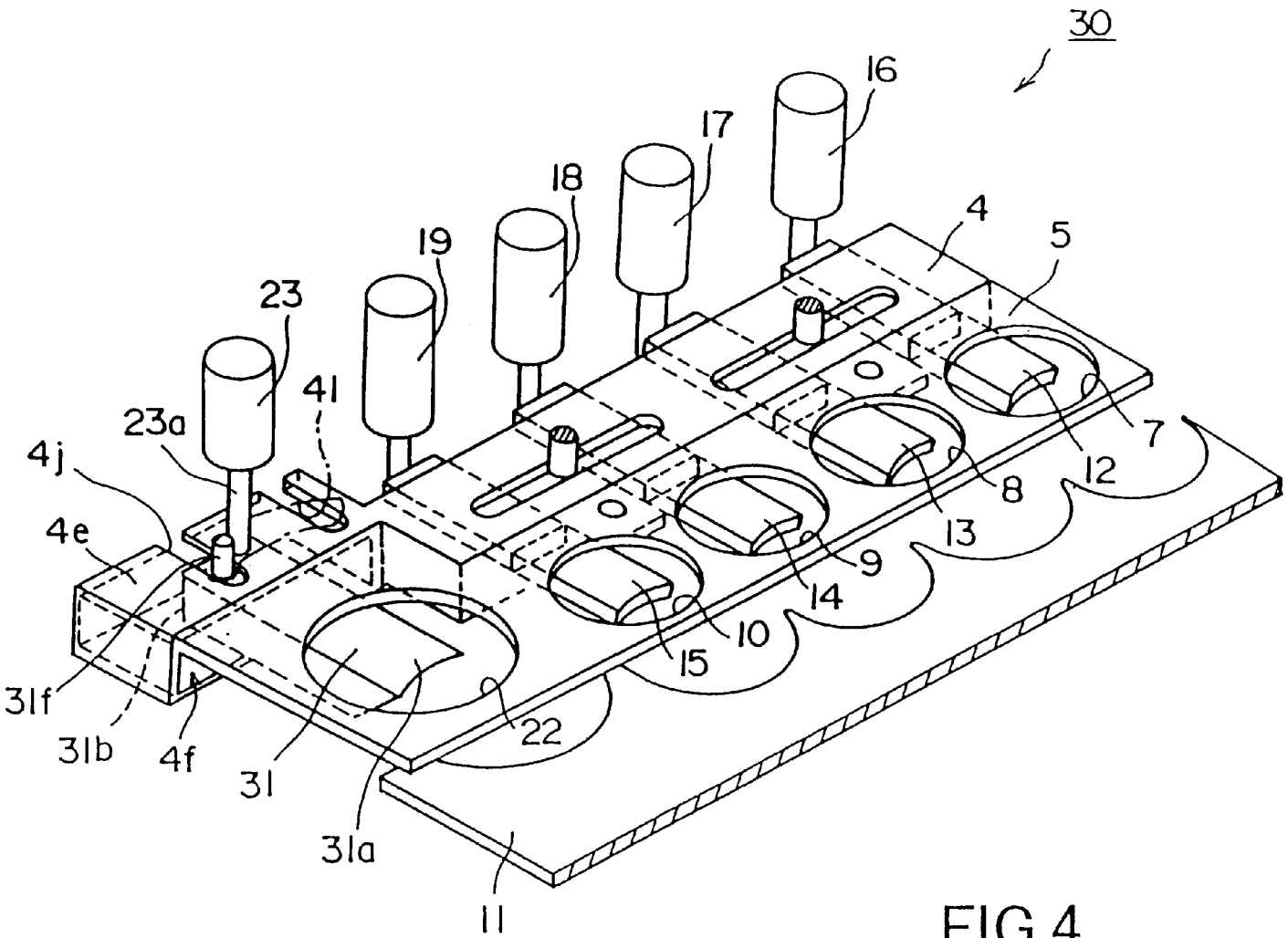
FIG. 4 is a schematic perspective view showing the action of a coin dispenser according to one embodiment of the present invention.

When the large-diameter coin held in the hole 22 should not be paid out, the engagement between the back end 31*b* of the change slide 31 and the change lever 23*a* of the change solenoid 23 is maintained, as depicted in FIG. 4, so that the change slide 31 is prevented from turning. Therefore, the change slide 31 maintains its stationary condition without being linked to the movement of the payout link 4. As a result, the tip 31*a* of the change slide 31 advances at the bottom of the hole 22 so as to close off the bottom of the hole 22, checking the falling of the coin held in the hole 22, and preventing that coin from being paid out.

A detailed description is given next of the change slide turning means that turns the change slide 31 in linkage with the sliding movement of the payout link 4 when coins are being paid out, as depicted in FIG. 3.

Figure 5:
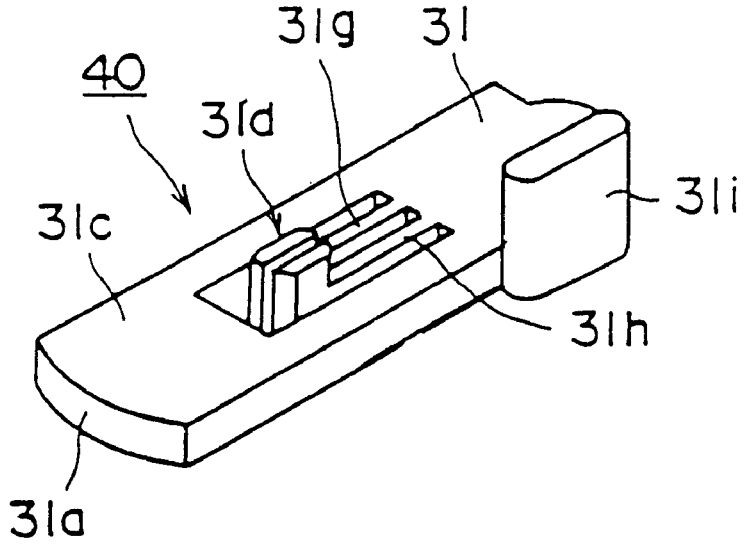
FIG. 5 is a schematic perspective view of the lower surface of a change slide.
Figure 6:
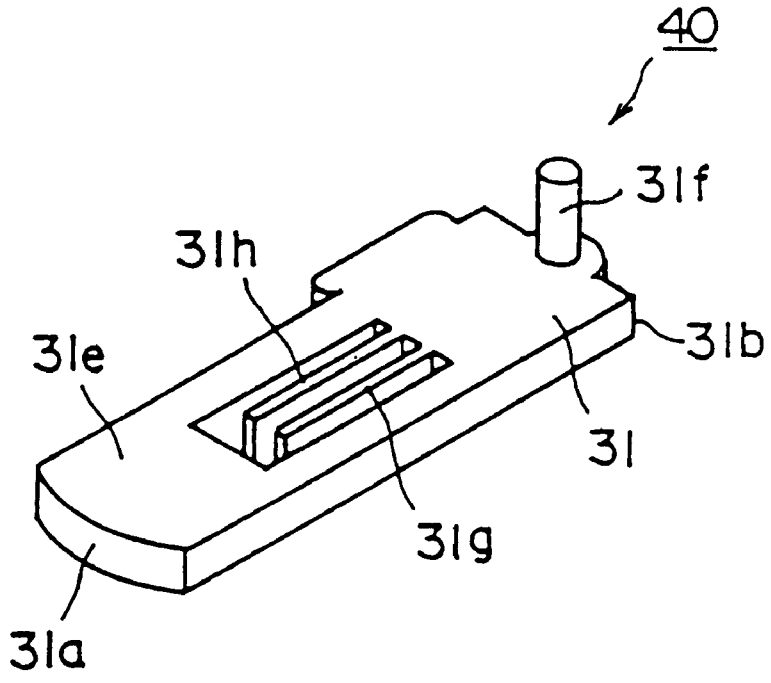
FIG. 6 is a schematic perspective view of the upper surface of a change slide.
Figure 7:
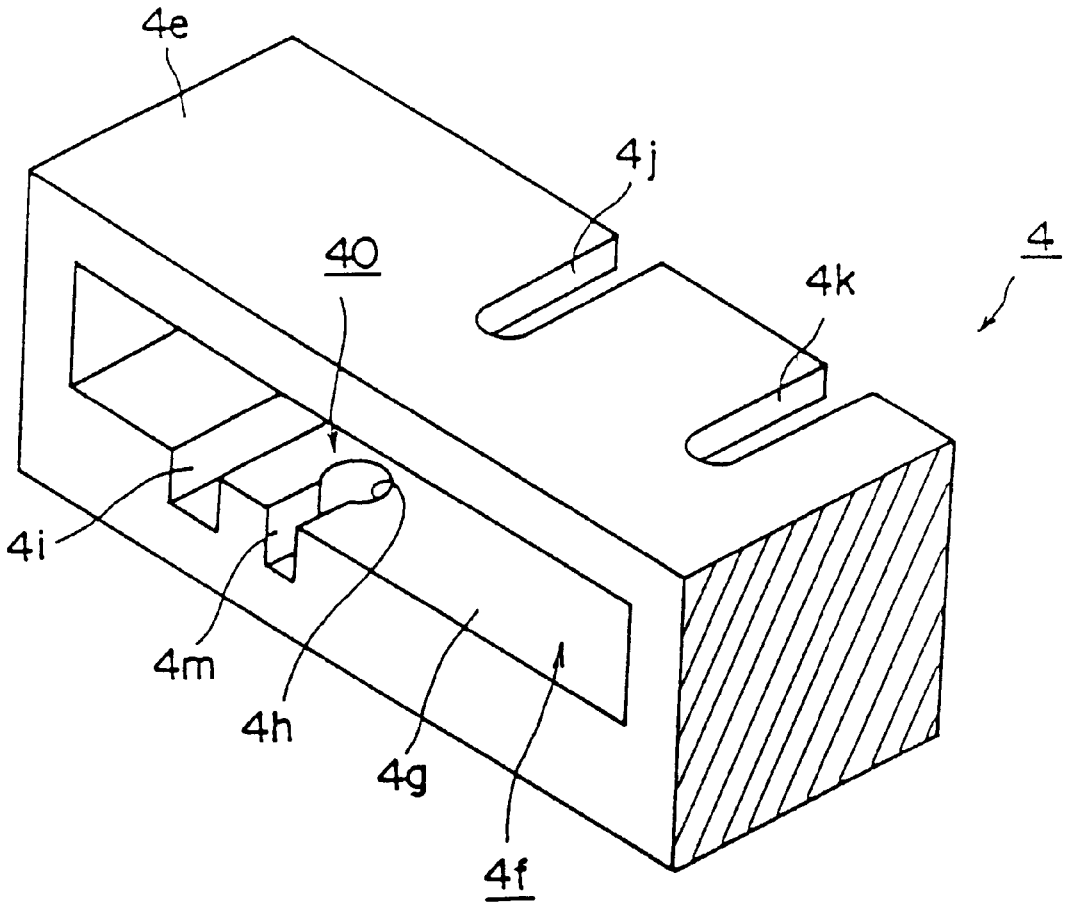
FIG. 7 is an enlarged schematic perspective view of the elongated portion of a change slide.

As is depicted in FIG. 5, which gives a perspective view of the bottom side of the change slide 31, the change slide turning means 40 comprises a turning shaft 31*d* that projects from the bottom surface 31*c* of the change slide 31, of such shape that its side surfaces are partially cut away; a cam shaft 31*f* on the upper surface 31*e* of the change slide 31, projecting up from the back end 31*b* of the change slide 31, as depicted in FIG. 6 which gives a perspective view of the upper surface of the change slide 31; a shaft bearing hole 4*h* formed in the lower surface 4*g* of the change slide storage hole 4*f*, as seen in the enlarged schematic perspective view of the elongated portion 4*e* of the payout link 4 given in FIG. 7; and an arc shaped cam channel 41 for guiding the cam shaft 31*f* that projects out from the change slide 31, as depicted in FIG. 1.

Of these, the arc shaped cam channel 41 is formed in the top cover (described below) that covers the upper surface of the payout link 4.

As is evident from FIG. 5, the shaft 31*d* is formed by the tip ends of a pair of shaft members 31*g* and 31*h* that are split into two forking prongs. Thus it is possible for the diameter of the shaft 31*d* to contract within that range wherein the gap between the tip ends of the pair of shaft members 31*g* and 31*h* flexibly expands and contracts. The reference symbol 31*i* in FIG. 5 indicates a guide panel that projects from the bottom surface 31*c* of the change slide 31.

The reference symbol 4*i* in FIG. 7 designates a guide channel formed adjacent to and to the left of the shaft bearing hole 4*h*. The guide channel 4*i* accepts the guide panel 31*i* on the change slide 31 depicted in FIG. 5.

The reference symbols 4*j* and 4*k* in FIG. 7 designate cam shaft accommodating channels for accommodating the cam shaft 31*f* depicted in FIG. 6. The reference symbol 4*m* in FIG. 7 designates a guide channel for guiding the turning shaft 31*d* depicted in FIG. 5, oriented toward the shaft bearing hole 4*h*, so that the turning shaft 31*d* can go in and out.

A more detailed description is given next of the action of the change slide turning means 40 described above.

Figure 8:
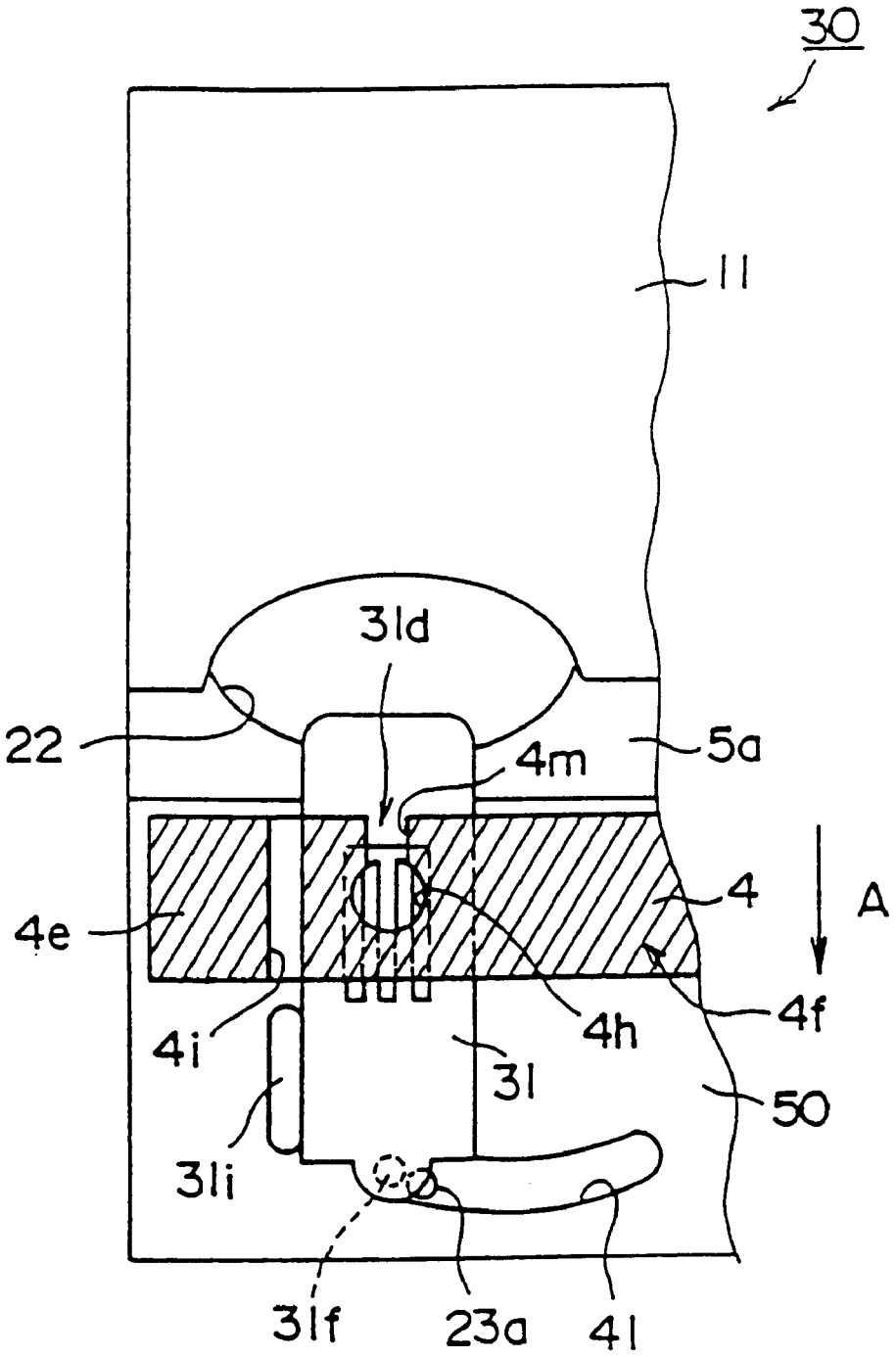
FIG. 8 is a partially cutaway bottom view of a coin dispenser according to one embodiment of the present invention, as seen from the bottom.

FIG. 8 is a partially cutaway bottom view of the coin dispenser 30 depicted in FIG. 1, as seen from the bottom. In particular, FIG. 8 details the elongated portions 4*e* and 5*a* of the payout link 4 and change slider 5, respectively.

In the initial position of the payout link 4 as depicted in FIG. 8, the turning shaft 31*d* of the change slide 31 fits inside the shaft bearing hole 4*h* formed inside the change slide storage hole 4*f* of the payout link 4.

The cam shaft 31*f* projecting from the upper surface of the change slide 31 fits inside the arc shaped cam channel 41 formed in the top cover 50 that covers the upper surface of the payout link 4, and the cam shaft 31*f* is engaged by the change lever 23*a* of the change solenoid 23 (cf. FIG. 1).

In the initial position of the payout link 4 depicted in FIG. 8, when a signal is input from the controller (not shown) not to pay out a large-diameter coin held in the hole 22, based on that non- payout signal, the payout cams 2 and 3 depicted in FIG. 1 turn through one revolution in the direction of the arrows causing the payout slider 5 to move reciprocally in the directions of the arrow A via the payout link 4. However, as depicted in FIG. 8, the engagement between the cam shaft 31*f* of the change slide 31 and the change lever 23*a* is maintained, wherefore the change slide 31 does not move in linkage with the payout link 4, but maintains its condition of being stopped in that position.

Thus, when the payout link 4 moves in the directions of the arrow A in FIG. 8, with the change slide 31 maintaining its stationary condition, the turning shaft 31*d* of the change slide 31 contracts its diameter, so that it can escape from the shaft bearing hole 4*h*, and moves inside the guide channel 4*m*, while, simultaneously, the guide panel 31*i* of the change slide 31 fits inside the guide channel 4*i* of the payout link 4.

Figure 9:
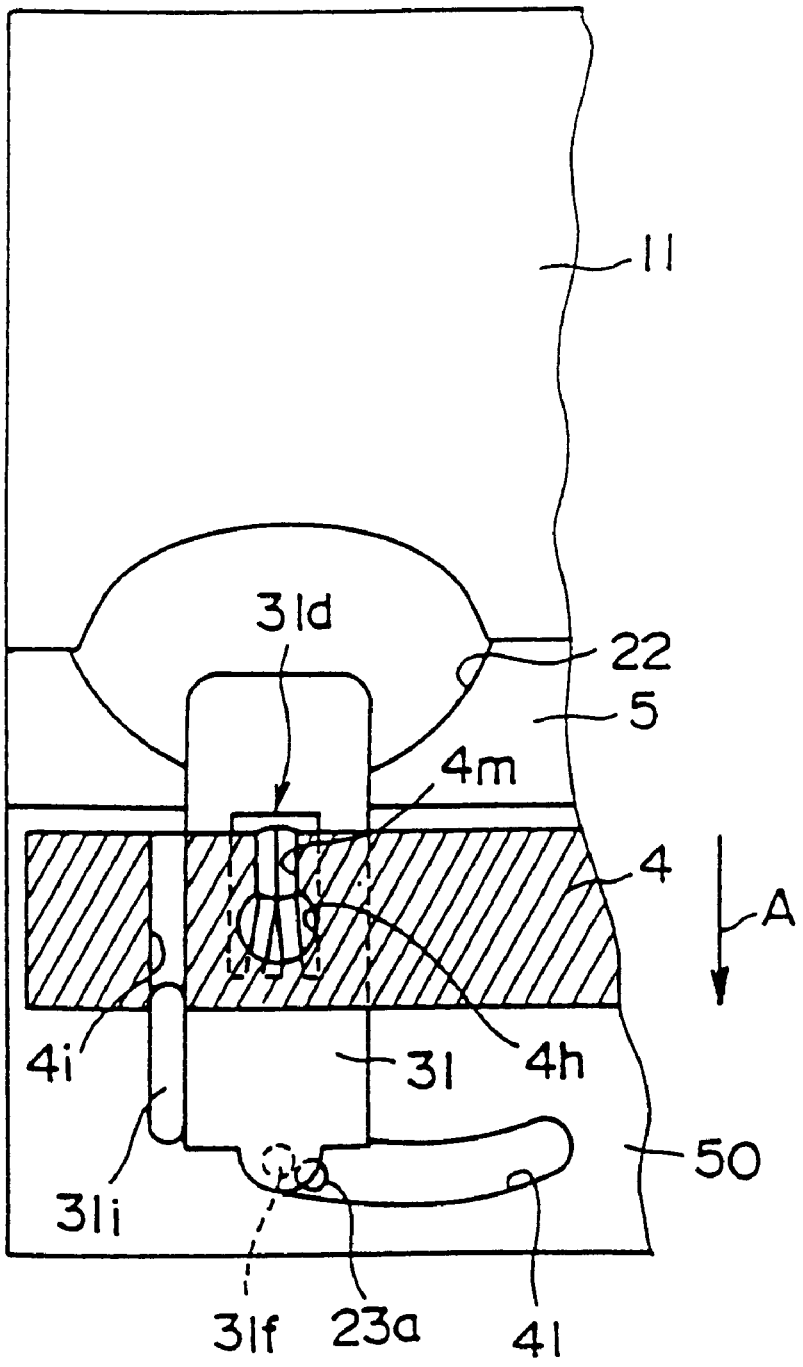
FIG. 9 is a partially cutaway bottom view indicating the action of a coin dispenser according to one embodiment of the present invention.
Figure 10:
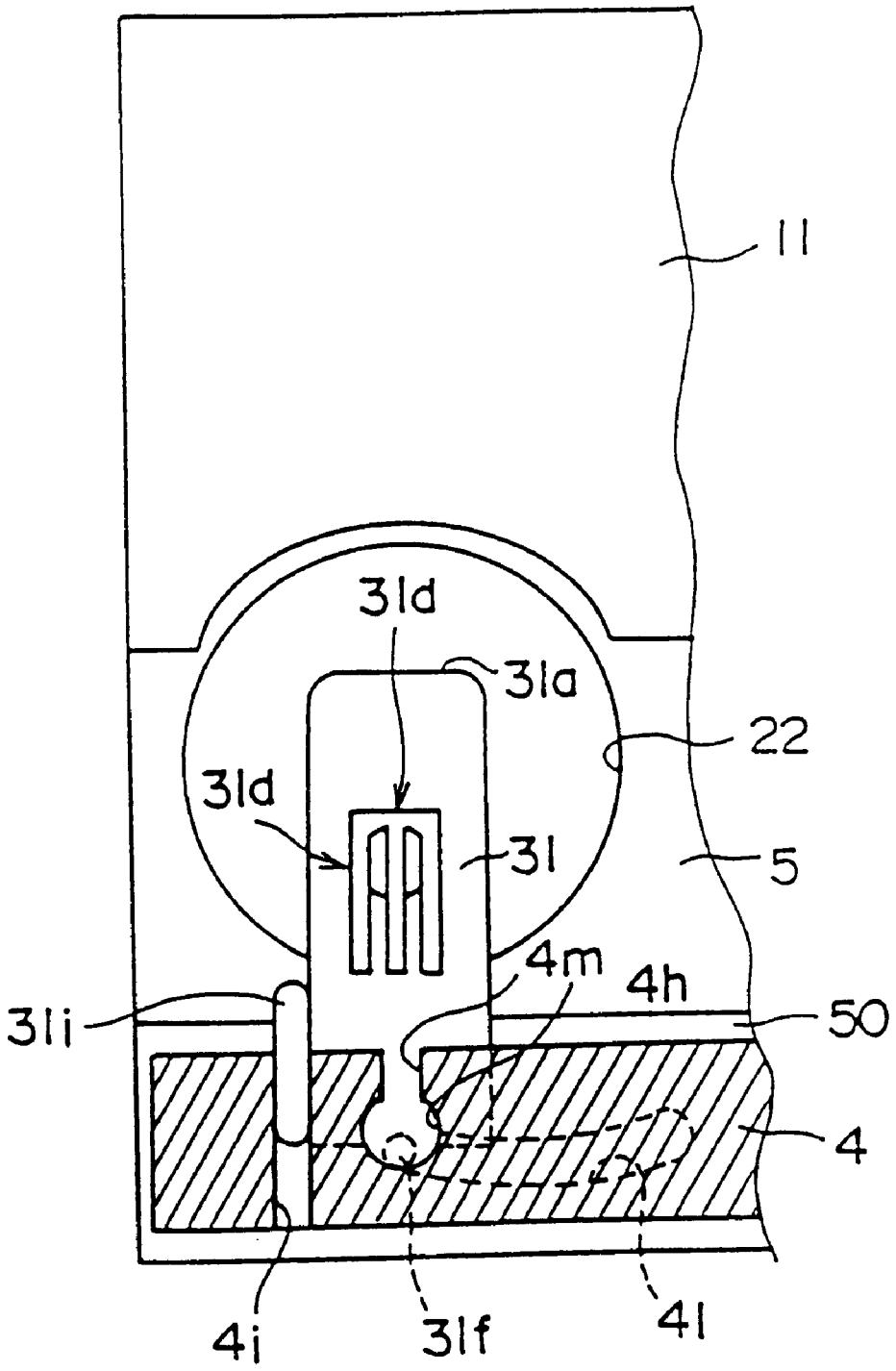
FIG. 10 is a partially cutaway bottom view indicating the action of a coin dispenser according to one embodiment of the present invention.

When the payout link 4 moves further in the direction of the arrow A indicated in FIG. 9, and arrives at the return point, the turning shaft 31*d* of the change slide 31 completely withdraws from inside the payout link 4, as depicted in FIG. 10, and the guide panel 31*i* of the change slide 31 reaches a state wherein it is partially inside the guide channel 4*i* in the payout link 4. Also, as depicted in FIG. 10, the guide panel 31*i* of the change slide 31 reaches a state wherein it is inside the guide channel 4*i* of the payout link 4. In this state, with the turning shaft 31*d* of the change slide 31 in a condition wherein it has completely withdrawn from inside the payout link 4, the change slide 31 will maintain its condition of being stopped in that condition, without shaking either to the right or left about the cam shaft 31*f*.

In the stopped position of the change slide 31 indicated in FIG. 10, the tip 31*a* thereof is completely advanced in the bottom of the hole 22, blocking off the bottom of the hole 22. As a result, the dropping of the coin held in the hole 22, i.e. the paying out thereof, is prevented. The manner of positioning the change slide 31 as depicted in FIG. 10 corresponds to the manner of positioning the change slide 31 as depicted in FIG. 4.

When the payout link 4 returns to its initial position from the position depicted in FIG. 10, the change slide 31 similarly returns to its initial position as depicted in FIG. 8.

According to the coin dispenser 30 described in the foregoing, in the initial position of the payout link 4 depicted in FIG. 8, when a signal is input from the controller (not shown) to pay out one large-diameter coin held in the hole 22, the engagement between the cam shaft 31*f* of the change slide 31 and the change lever 23*a* is released in response to that coin payout signal (cf. FIG. 2).

Subsequently, the payout cams 2 and 3 turn through one revolution in the direction of the arrows, as depicted in FIG. 2, thereby causing, via the payout link 4, the payout slider 5 to move reciprocally in the directions indicated by the arrow A.

Figure 11:
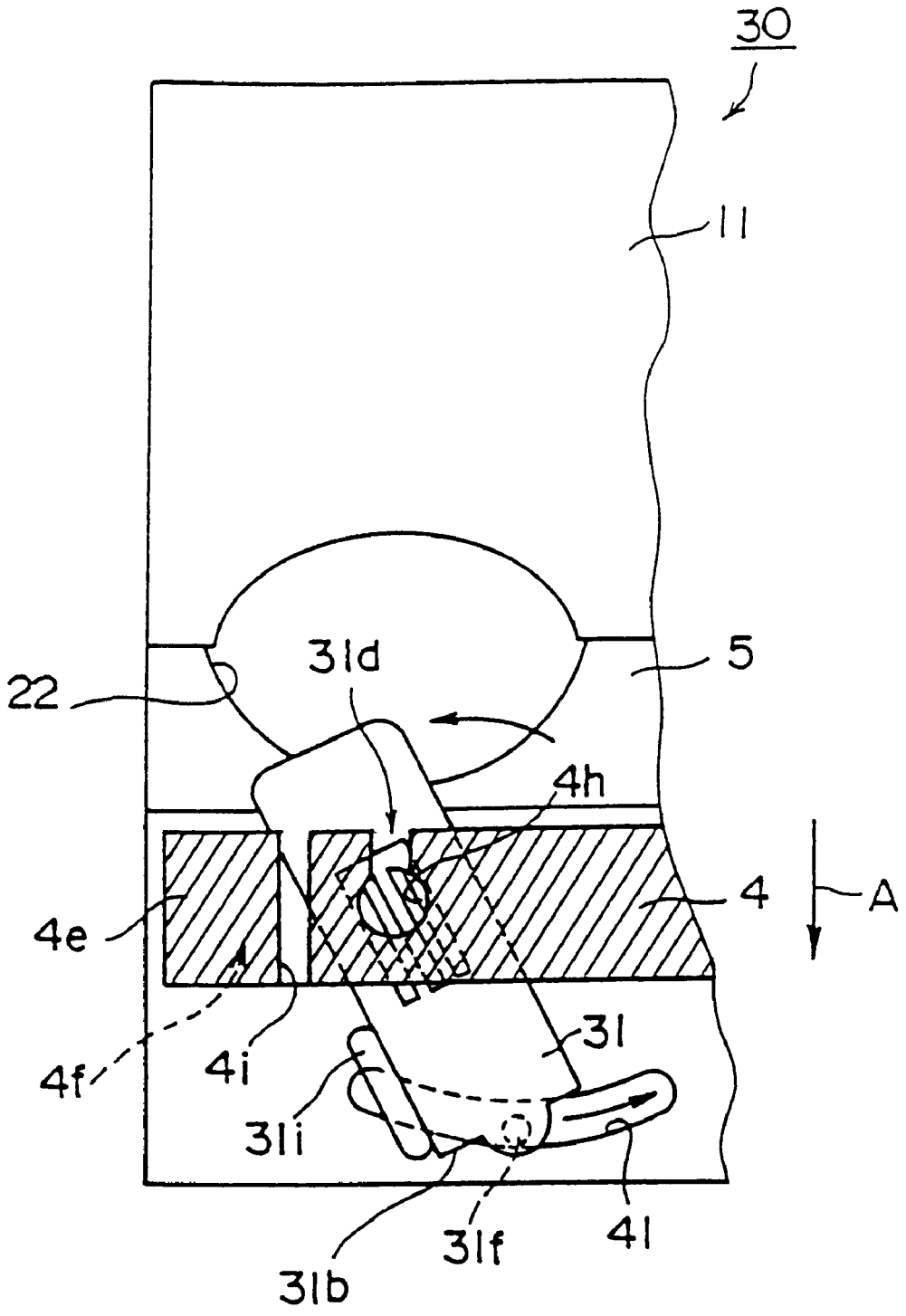
FIG. 11 is a partially cutaway bottom view indicating the action of a coin dispenser according to one embodiment of the present invention.

As this happens, when the payout link 4 moves slightly in the direction of the arrow A, as depicted in FIG. 11, the change slide 31 is pushed in the direction of the arrow A via the turning shaft 31*d* inserted into the turning bearing hole 4 in the payout link 4, but the engagement between the cam shaft 31*f* and the change lever 23*a* (cf. FIG. 8) has been released, so the back end 31*b* of the change slide 31 moves toward the right (in the drawing) along the arc shaped cam channel 41 in which the cam shaft 31*f* is inserted, while, simultaneously, the change slide 31 turns counterclockwise about the turning shaft 31*d* that is inserted in the shaft bearing hole 4*h*. In other words, its attitude begins to change.

Figure 12:
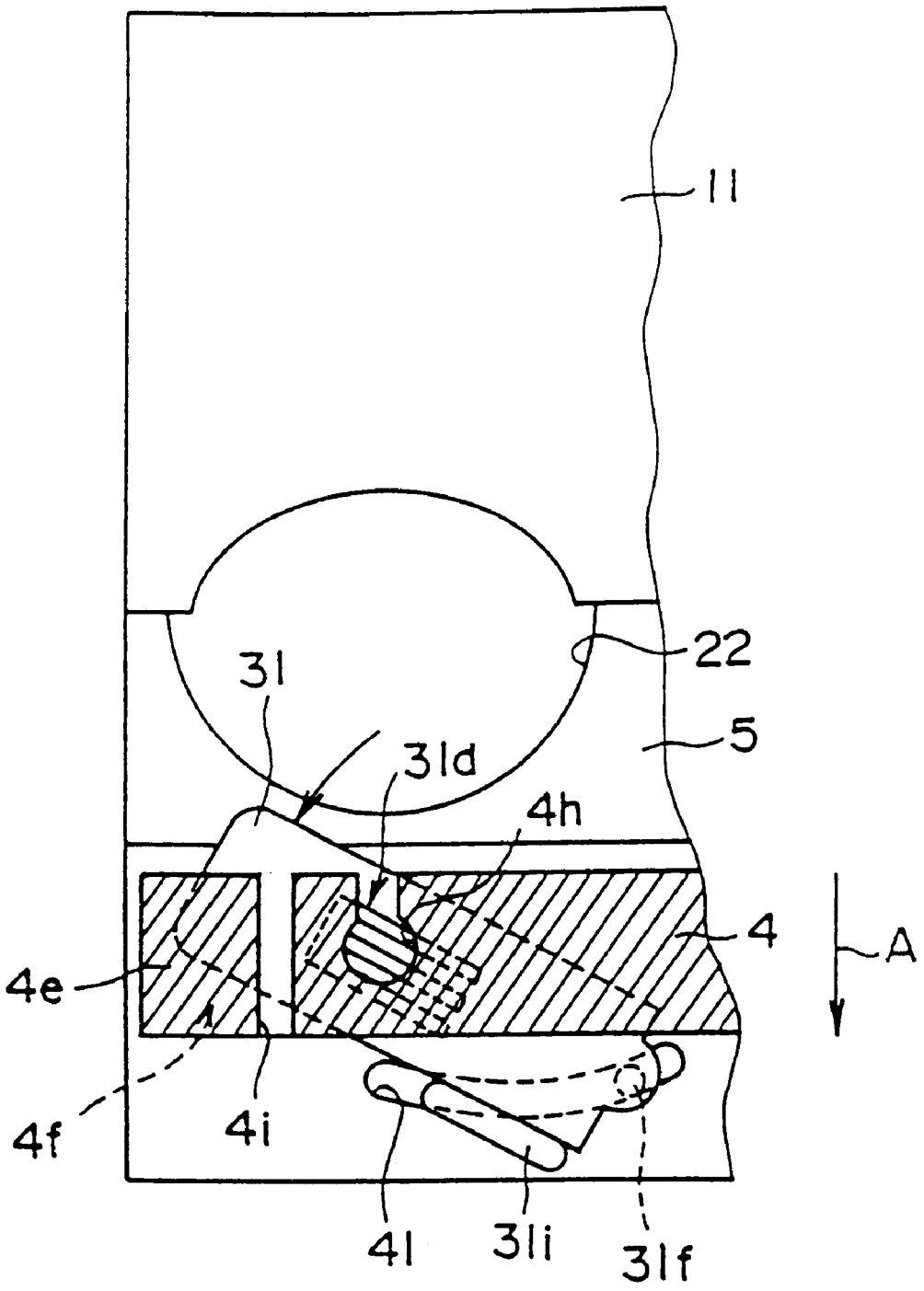
FIG. 12 is a partially cutaway bottom view indicating the action of a coin dispenser according to one embodiment of the present invention.

Then, when the payout link 4 moves further in the direction of the arrow A, as depicted in FIG. 12, the change slide 31 turns further in the counterclockwise direction about the turning shaft 31*d* that is inserted in the shaft bearing hole 4*h*, whereby the turning attitude is increased, and the entire change slide 31 is thrust into the change slide storage hole 4*f* of the payout link 4 along the longitudinal direction thereof.

When the payout link 4 moves further in the direction of the arrow A from the position depicted in FIG. 12 and arrives at the return point thereof, the entire change slide 31, except for the guide panel 31*i*, is accommodated inside the change slide storage hole 4*f* of the payout link 4 along the longitudinal direction thereof.

Figure 13:
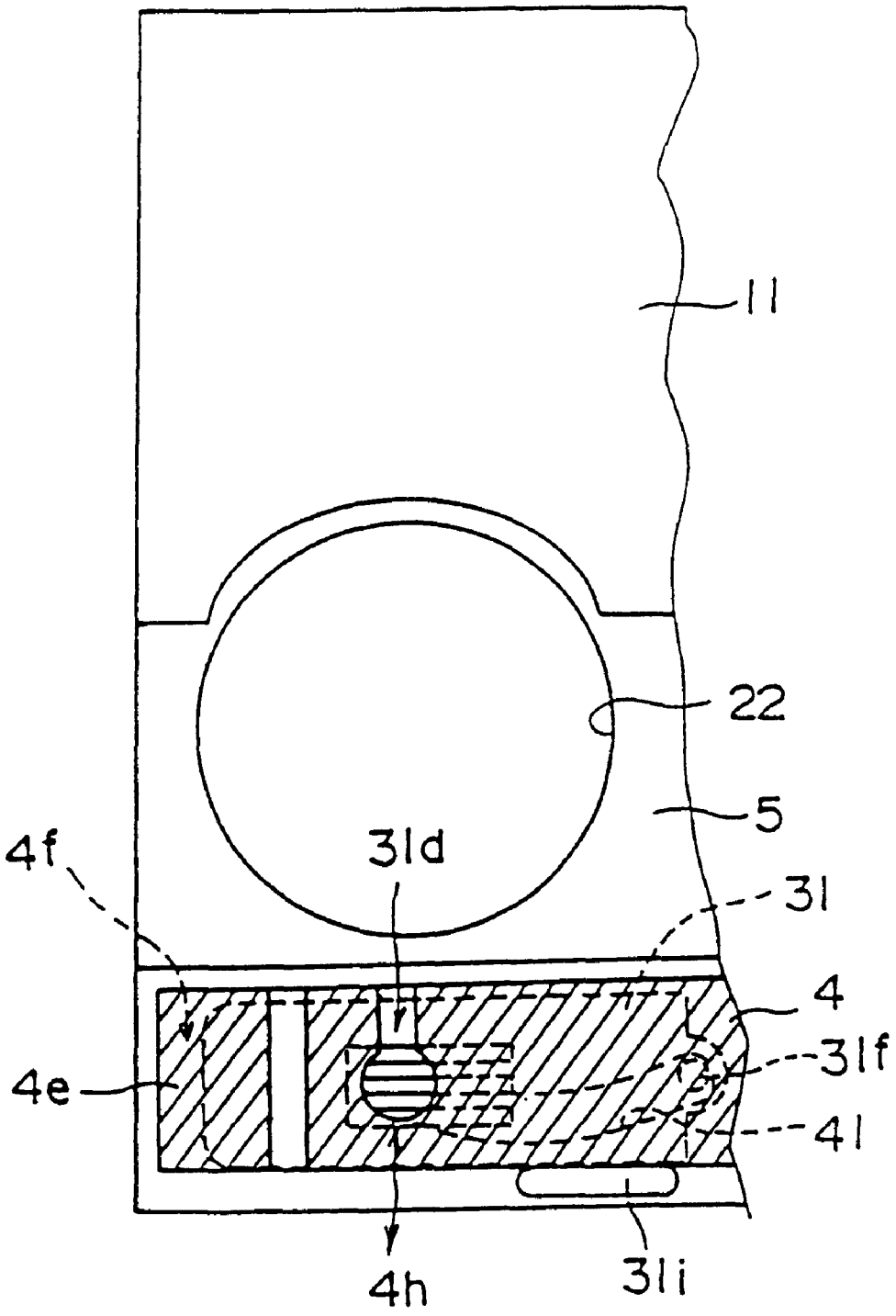
FIG. 13 is a partially cutaway bottom view indicating the action of a coin dispenser according to one embodiment of the present invention.

In this position wherein the change slide 31 is stopped as depicted in FIG. 13, the entirety thereof is accommodated inside the change slide storage hole 4*f* in the payout link 4 along the longitudinal direction thereof, and the release of the entire bottom of the hole 22 in the change slider 5 is maintained. As a result, the coin held in the hole 22 drops down and is paid out. The manner of positioning the change slide 31 as depicted in FIG. 13 corresponds to the manner of positioning the change slide 31 depicted in FIG. 3.

Accordingly, when the coin dispenser 30 described in the foregoing is implemented, as depicted in FIG. 3, the dimension M in the depth direction from the front to the back of the coin dispenser 30 inclusive of the distance of reciprocal movement of the change slide 31 when paying out coins is far shorter than in the conventional apparatus, because the change slide 31 itself is accommodated inside the payout link 4, thus making it possible to shorten the dimension in the depth direction of the coin dispenser 30 to the maximum extent possible.

In the embodiment described in the foregoing, the coin dispenser 30 of the present invention is applied to the paying out and non-paying out of a relatively large-diameter coin held in the hole 22 in the payout slider 5, but the present invention is in no way limited by the embodiment so described, and may be applied to the paying out and non-paying out of coins held in the other holes formed in the payout slider 5, namely the holes 7, 8, 9 and 10, in which case it would be possible to even further shorten the dimension in the depth direction of the coin dispenser overall, as compared to the conventional apparatus.

Figure 14:
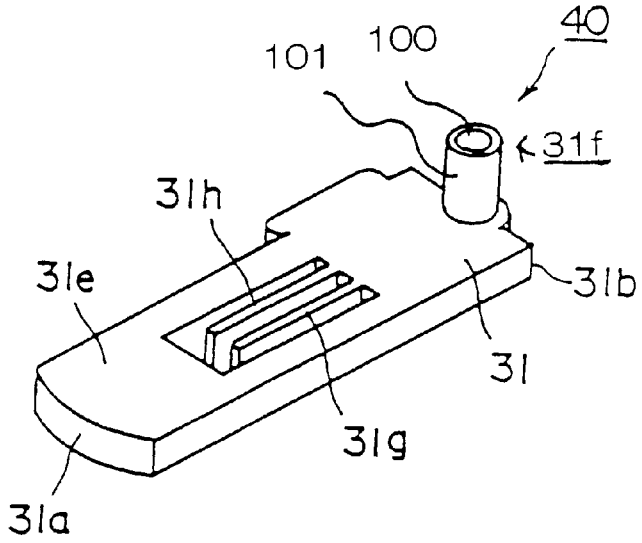
FIG. 14 is a schematic perspective view of a change slide according to another embodiment of the present invention.

In the embodiment described in the foregoing, the cam shaft 31*f* is integrally formed with the upper surface 31*e* of the change slide 31, as shown in FIG. 6. However, the present invention is not limited to this embodiment. Alternatively, as shown in FIG. 14 in which the same reference symbols as used in FIG. 6 are used to indicate identical components, it may be so construction that a metal shaft member 100 is pressed into the upper surface 31*e* of the change slide 31 in place of the cam shaft 31*f*, and a roller 101 is rotatably supported by the metal shaft member 100.

With this alternative construction where the cam shaft 31*f* is constituted by the metal shaft member 100 and the roller 101, not only the engagement of the cam shaft 31*f* and the arc shaped cam channel 41 become smooth as shown in FIG. 11, etc., but also durability of the cam shaft 31*f* improves so that a coin dispenser of long life can be realized.

Figure 15:
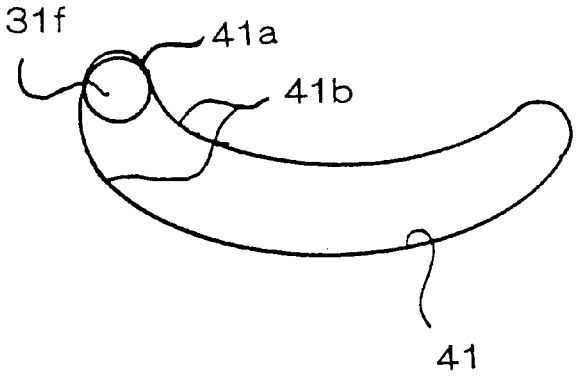
FIG. 15 is a schematic plan view of a cam channel according to another embodiment.

Further, in the embodiment described in the foregoing, the cam channel 41 is formed in a simple arc shape as shown in FIG. 11. Alternatively, as shown in FIG. 15 showing the cam shaft 31*f* and the cam channel 41 engaged with the cam shaft 31*f* in an enlarged manner, the starting end 41*a* of the cam channel 41 may be formed to have a cam channel portion 41*b* having a smaller radius of curvature compared with the other portions thereof.

With this construction where the cam channel portion 1*b* of a smaller radius of curvature is formed at the staring end 41*a* of the channel 41, when the cam shaft 31*f* reaches the cam channel portion 41*b* during the returning of the change slide 31 to its initial position, the cam shaft 31*f* returns rapidly to the starting end 41*a*. As a result, the change slide 31 can return to its initial position (FIG. 8) rapidly and reliably.

Figure 16:
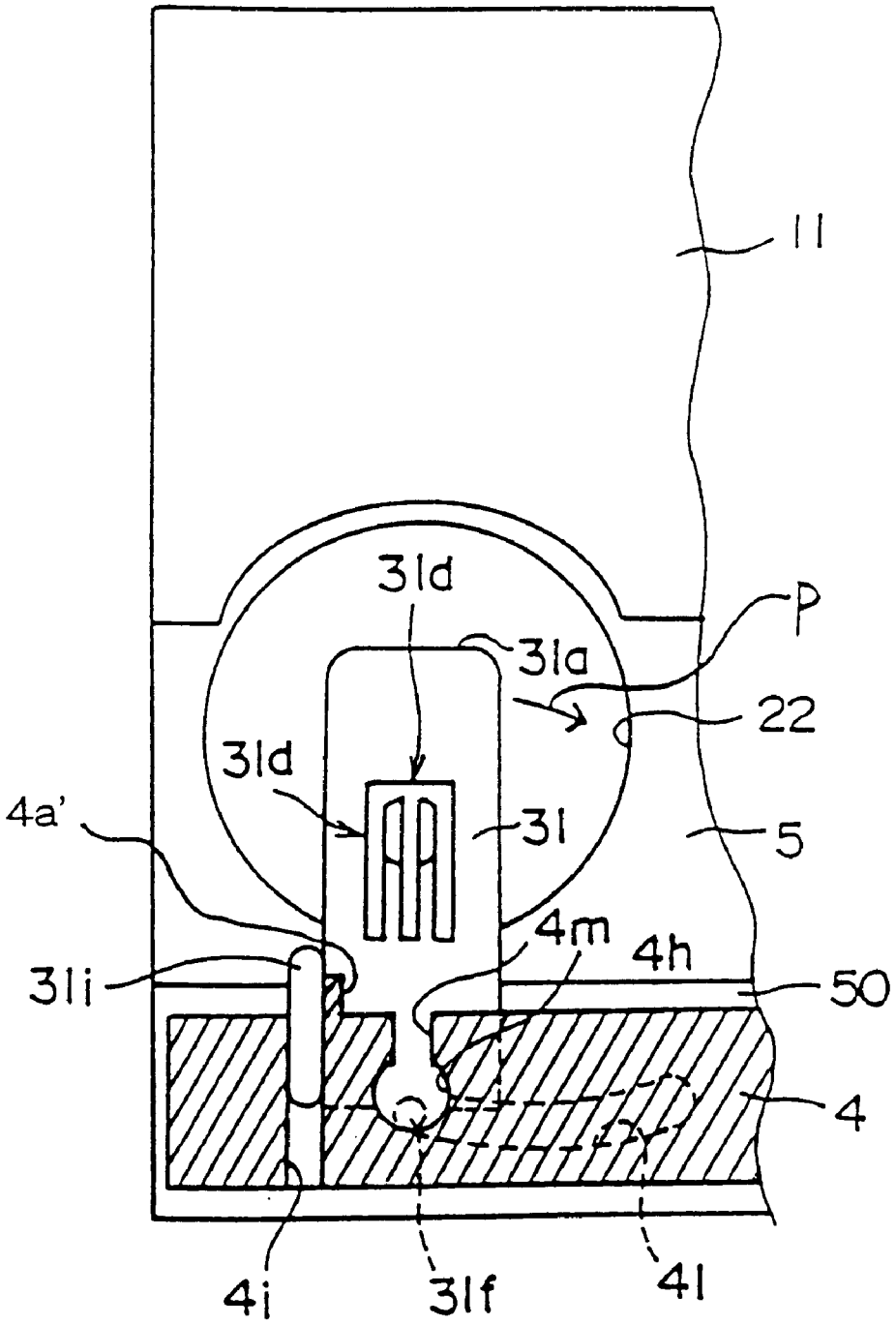
FIG. 16 is a partially cutaway view of major portions of a payout link of another embodiment.

Further, as shown in FIG. 16 in which the same reference symbols as used in FIG. 10 are used to indicate identical components, it may be so constructed that a protrusion 4*a*' is provided at the fore end of the payout link 4 to prevent the change slide 31 from rotating in the direction of arrow P when the tip 31*a* of the change slide 31 advances and enters completely the bottom of the hole 22 so as to close off the bottom of the hole 22, and the protrusion 4*a*' is made abutted to the guide panel 31*i*.

Figure 17:
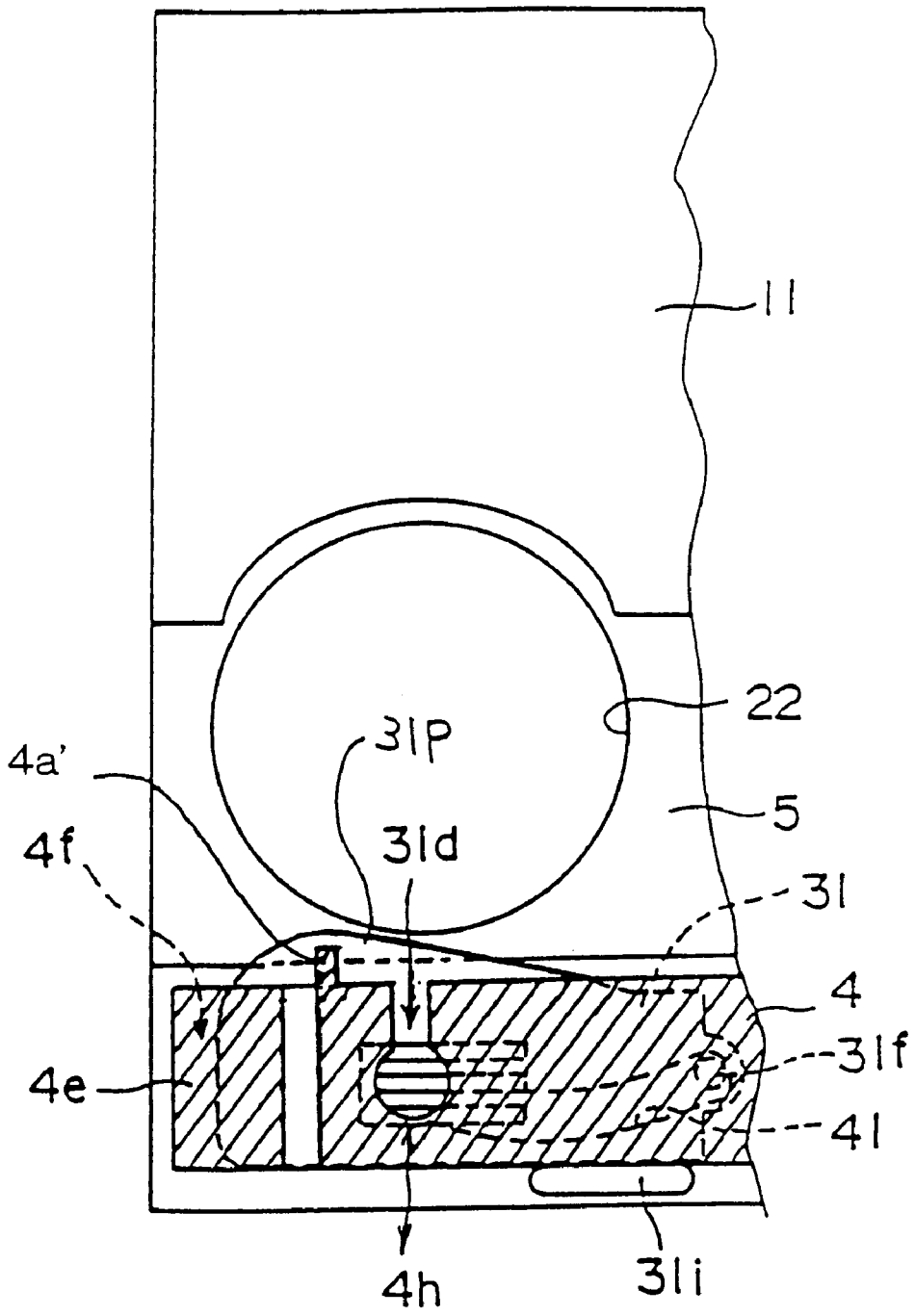
FIG. 17 is a partially cutaway view of major portions of a payout link of still another embodiment.

With this construction, it may happen that a payout coin is clogged in a gap formed between the payout slide 5 and the protrusion 4*a*'. To prevent this clogging, as shown in FIG. 17 in which the same reference symbols as used in FIG. 13 are used to indicate identical components, a protruding portion 31*p* is provided at the side of the change slide 31 to cover the gap formed between the payout slide 5 and the protrusion 4*a*'. With the protruding portion 31*p* provided at the side of the change slide 31, the gap formed between the payout slide 5 and the protrusion 4*a*' can be covered so as to prevent a payout coin from being clogged in the gap. As a result, the payout coin can smoothly drop through the hole 22 and be paid out.

With the coin dispenser of the present invention, as described in the foregoing, a change slide that controls the payout and non-payout of coins is made to revolve so that it is accommodated inside the payout link when coins are being paid out, thereby making it possible to set the distance of fore-and-aft movement of the change slide needed during coin payout to be extremely short. Thus the dimension in the depth direction of the coin dispenser can be set to be extremely short also, and the coin dispenser made compact.

Because the coin dispenser can be made compact, furthermore, coin dispensers can be provided that exhibit functions for paying out many kinds of coins, without altering the basic sizes thereof in the depth dimension, even when they are employed in different countries of the world using coins of different types and diameters.

INDUSTRIAL APPLICABILITY

As described in the foregoing, the coin dispenser of the present invention is a compact apparatus, making it ideal for coin dispensers that pay out many different types of coins, without altering the basic size thereof in the depth dimension, when employed in different countries of the world using coins of different types and diameters.

What is claimed is:

1. A coin dispenser that causes a payout slider to move reciprocally via a payout link, and comprises a change slide that opens coin holding holes formed in the payout slider when paying out coins so as to drop the coins held in the coin holding holes down, and closes off the coin holding holes when not paying out coins so as to prevent coins from falling down, characterized in that the coin dispenser further comprises:

change slide accommodating means for accommodating the change slide inside the payout link along longitudinal direction thereof; and change slide turning means for turning the change slide in conjunction with movement of the payout link when paying out coins, wherein when paying out the coins, the change slide is turned by the change slide turning means so as to be accommodated inside the change slide accommodating means.

2. The coin dispenser according to claim 1, wherein the change slide accommodating means comprises a change slide storage hole formed in the payout link, for accommodating the change slide along longitudinal direction thereof.

3. The coin dispenser according to claim 1, wherein the change slide turning means comprises:

a turning shaft that projects from a bottom surface of the change slide;

a cam shaft that projects at upper surface of the change slide;

a shaft bearing hole formed in the change slide storage hole, for supporting the turning shaft; and an arc shaped cam channel formed in a top cover that covers the payout link, for guiding the cam shaft.

* * * * *